US008465328B2

(12) United States Patent
Iida et al.

(10) Patent No.: US 8,465,328 B2
(45) Date of Patent: Jun. 18, 2013

(54) CONNECTOR ASSEMBLY AND MALE-SIDE CONNECTOR

(75) Inventors: Mituru Iida, Matsusaka (JP); Hiroshi Iwano, Tsu (JP); Daisuke Sato, Tsu (JP)

(73) Assignee: Panasonic Corporation, Osaka (JP)

( * ) Notice: Subject to any disclaimer, the term of this patent is extended or adjusted under 35 U.S.C. 154(b) by 69 days.

(21) Appl. No.: 13/311,040

(22) Filed: Dec. 5, 2011

(65) Prior Publication Data

US 2012/0149246 A1 Jun. 14, 2012

(30) Foreign Application Priority Data

Dec. 9, 2010 (JP) ..... 2010-274211

(51) Int. Cl.
*H01R 24/00* (2011.01)

(52) U.S. Cl.
USPC ..... 439/660

(58) Field of Classification Search
USPC ..... 439/66, 74, 75, 68–69, 931, 70
See application file for complete search history.

(56) References Cited

U.S. PATENT DOCUMENTS

| | | | | |
|---|---|---|---|---|
| 5,460,531 | A * | 10/1995 | Vivio | 439/70 |
| 7,083,446 | B2 * | 8/2006 | Tanaka et al. | 439/159 |
| 7,674,114 | B2 | 3/2010 | Tanaka et al. | |
| 2007/0161274 | A1 * | 7/2007 | Tanaka et al. | 439/159 |

FOREIGN PATENT DOCUMENTS

| | | |
|---|---|---|
| JP | 2009-277534 | 11/2009 |

* cited by examiner

*Primary Examiner* — Jean F Duverne
(74) *Attorney, Agent, or Firm* — Greenblum & Bernstein, P.L.C.

(57) ABSTRACT

On a front surface (one of opposite surfaces) 11*a* of a male-side connector 10, first guide projections 15 are provided, which have a projection height that is higher than columnar bumps (male-type terminal portions) 13. and on a back surface (other of the opposite surfaces) 21*b* of a female-side connector 20, hole portions 25 are provided, which have a size allowing slight movement of the first guide projections 15, wherein the columnar bumps 13 and the cross-like slits (female-type terminal portions) 23 are positioned with each other by the first guide projections 15 being inserted through the hole portions 25.

6 Claims, 10 Drawing Sheets

CONNECTOR ASSEMBLY AND MALE-SIDE CONNECTOR

CROSS REFERENCE TO RELATED APPLICATIONS

This application is based upon and claims the benefit of priority from prior Japanese Patent Application P2010-274211 filed on Dec. 9, 2010; the entire contents of which are incorporated by reference herein.

BACKGROUND OF THE INVENTION

The present invention relates to a connector assembly and a male-side connector.

Heretofore, for example, as disclosed in Japanese Patent Laid-Open Publication No. 2009-277534, a connector assembly has been known, in which positioning columnar projections (guide projections) and positioning ring bodies (hole portions) are provided on opposite surfaces of a male-side connector having male-type terminal portions and of a female-side connector having female-type terminal portions.

SUMMARY OF THE INVENTION

In such a conventional connector assembly as described above, the columnar projections are fitted into the ring bodies while being inserted thereinto, whereby accurate positioning of the male-type terminal portions and the female-type terminal portions is performed, and the two connectors on which these male-type and female-type terminal portions are formed can be united with each other.

However, in a configuration in which the columnar projections are fitted into the ring bodies from the beginning, at the time of assembling the connector assembly, the insertion of the columnar projections into the ring bodies becomes tight, and connection therebetween becomes difficult, and as a result, there has been an apprehension that assembly workability for the male-side connector and the female-side connector may be deteriorated.

In this connection, it is an object of the present invention to obtain a connector assembly capable of enhancing the assembly workability for the male-side connector and the female-side connector while positioning the male-type terminal portions and the female-type terminal portions to each other, and to obtain the male-side connector capable of enhancing the assembly workability for the connector assembly concerned.

In order to achieve the foregoing object, a connector assembly, comprising: a male-side connector having a male-type terminal portion; a female-side connector having a female-type terminal portion, the male-side connector and the female-side connector being united with each other while the male-type terminal portion and the female-type terminal portion are brought into contact with each other; a first guide projection provided on one of opposite surfaces of the male-side connector and the female-side connector that face with each other, the first guide projection having a projection height that is higher than that of the male-type terminal portion; and a hole portion formed at the other of the opposite surfaces, the hole portion having a size allowing slight movement of the first guide projection, in which the male-type terminal portion and the female-type terminal portion are positioned with each other by the first guide projection being inserted through the hole portion.

In accordance with the connector assembly of the present invention, the first guide projection higher in projection height than the male-type terminal portion is inserted into the hole portion, whereby rough alignment between the male-type terminal portion and the female-type terminal portion is performed. Accordingly, the assembly workability for the male-side connector and the female-side connector can be enhanced.

DETAILED DESCRIPTION OF THE PREFERRED EMBODIMENTS

Figure 1:
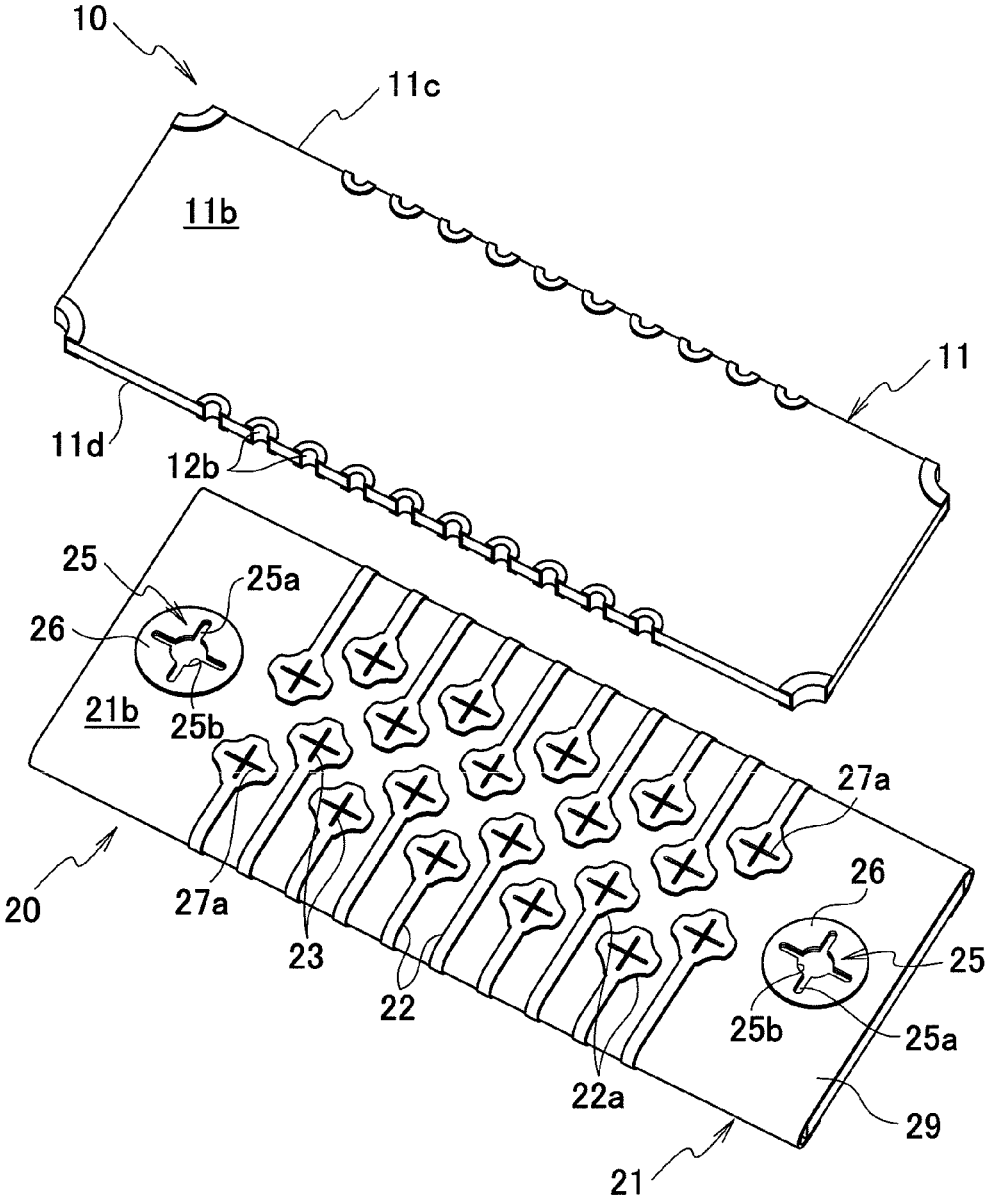
FIG. 1 is a perspective view of a connector assembly according to one embodiment of the present invention, showing a back surface of a male-side connector and a front surface of a female-side connector.

A description is made below in detail of embodiments of the present invention while referring to the drawings.

Figure 2:
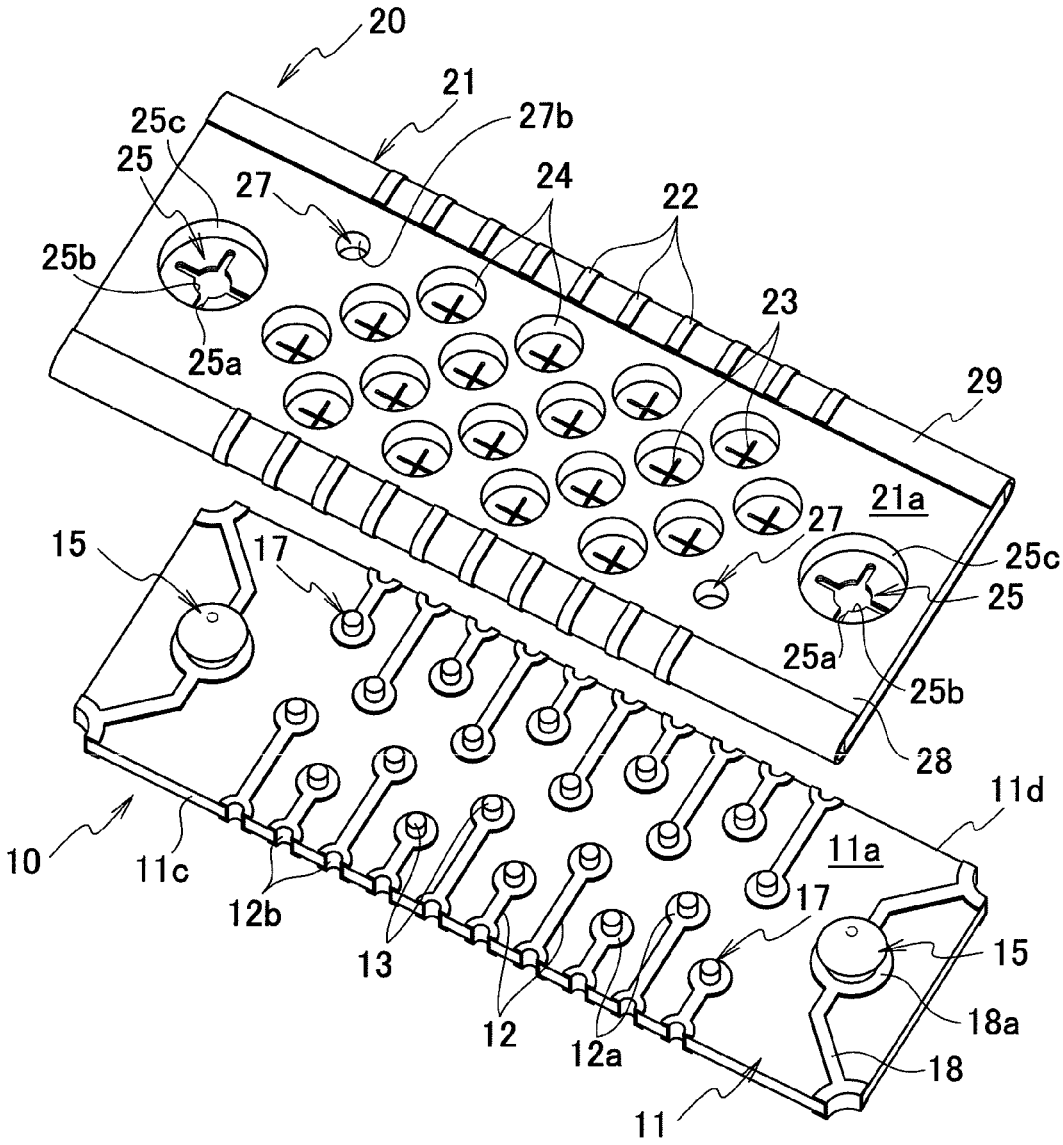
FIG. 2 is a perspective view of the connector assembly according to the one embodiment of the present invention, showing a front surface of the male-side connector and a back surface of the female-side connector.
Figure 3:
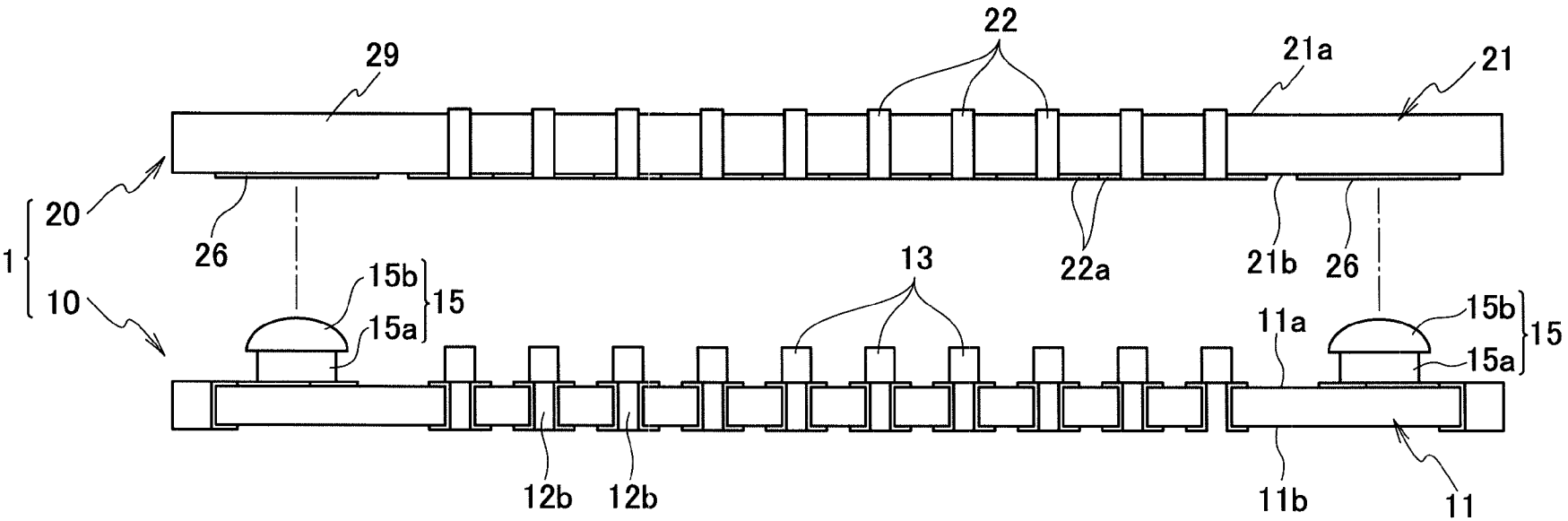
FIG. 3 is a side view showing an assembly status of the male-side connector and the female-side connector, which are shown in FIG. 1 and FIG. 2.
Figure 4:
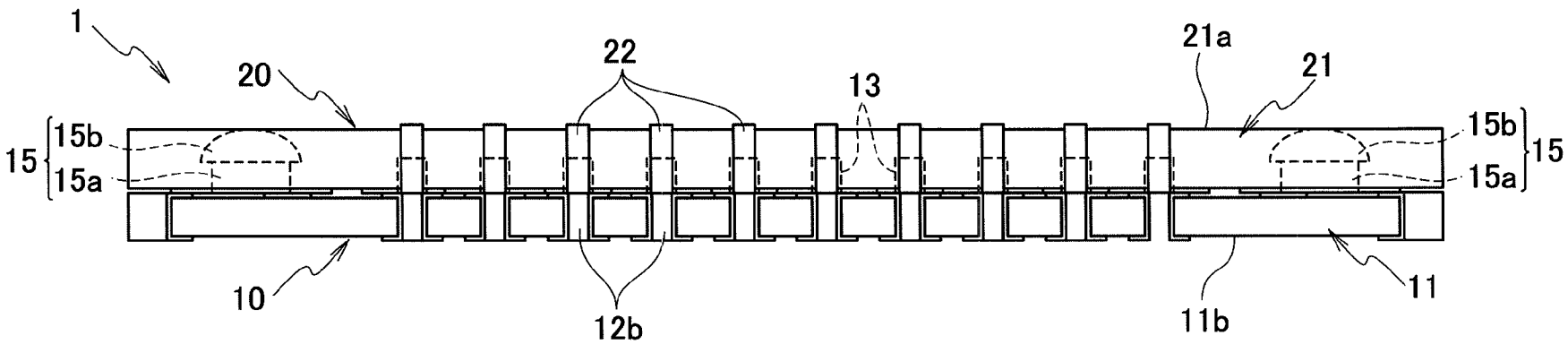
FIG. 4 is a side view of the connector assembly in which the male-side connector shown in FIG. 3 and the female-side connector shown in FIG. 3 are united with each other.

FIG. 1 to FIG. 8 are views showing one embodiment of a connector assembly according to the present invention. A male-side connector 10 and a female-side connector 20, which are shown in FIG. 1 to FIG. 3, are united with each other, whereby a connector assembly 1 shown in FIG. 4 is formed.

As shown in FIG. 1 and FIG. 2, the female-side connector 20 is formed as an FPC board by patterning plural lines of conductor circuits 22 on a back surface 21*b* of a base board 21, which has an insulating film 29 made of polyimide resin, glass epoxy or the like. On terminals of the conductor circuits 22, cross-like slits 23 as female-type terminal portions are individually formed.

Each of the cross-like slits 23 is concentrically formed in each of center portions of wide cross-like pad portions 22*a* provided on the terminals of the conductor circuits 22, and penetrates each of the cross-like pad portions 22*a* and the base board 21. That is to say, in this embodiment, a plurality of through holes 24 are provided in a board body 28 (refer to FIG. 2) formed of synthetic resin or the like, and the cross-like slits 23 are formed so as to communicate with the through holes 24, whereby the cross-like slits 23 penetrate the cross-like pad portions 22*a* and the base board 21.

Then, the plurality of cross-like slits 23 are arrayed on the base board 21 orderly in a matrix form. In this embodiment, four lines of the cross-like slits 23, each line of which has four or five cross-like slits arrayed in a longitudinal direction of the base board 21 (excluding cross-like slits 27*a* of engagement holes 27 to be described later), are provided. That is to say, totally 18 pieces of cross-like slits 23 are provided. At this time, the lines adjacent to one another in a width direction of the base board 21 are arranged so as to be offset with respect to one another.

As shown in FIG. 1 and FIG. 2, the male-side connector 10 includes a rectangular base board 11 that is formed of an insulating material such as synthetic resin and allows four corners thereof to be chamfered. The male-side connector 10 is formed by projecting columnar bumps 13 as male-type terminal portions on a front surface 11*a* of the base board 11.

The columnar bumps 13 are provided on annular pad portions 12*a* provided on one-side ends of conductor circuits 12 extended from both side portions 11*c* and 11*d* in a width direction of the base board 11 toward an inside in the width direction. The columnar bumps 13 are arranged so as to correspond to the respective positions where the cross-like slits 23 are formed, and totally 18 pieces thereof are provided.

Note that the columnar bumps 13 are formed of a conductive material such as metal and conductive resin, and are formed in a columnar shape with a diameter that enables insertion (press-fitting) thereof into the cross-like slits 23 while deforming peripheral edge portions of the cross-like slits 23. At this time, in order to push and open the cross-like slits 23 equally in a circumferential direction thereof, preferably, the columnar bumps 13 have such a columnar shape in which a cross section is circular; however, such a cross-sectional shape thereof is not particularly limited to the circular shape, and may be a noncircular shape such as an ellipsoidal shape and a polygonal shape.

Then, other-side ends of the conductor circuits 12 connected to the columnar bumps 13 are exposed to the both side portions 11*c* and 11*d* in the width direction of the base board 11, and exposed surfaces 12*b* of the conductor circuits 12 serve as contacts with other circuit board and electronic component (not shown).

Here, in this embodiment, on the front surface 11*a* of the base board 11 of the male-side connector 10, which is one of opposite surfaces of the male-side connector 10 and the female-side connector 20, there are provided first guide projections 15 higher in projection height than the above-mentioned columnar bumps 13. The first guide projections 15 are formed of metal, high-rigidity synthetic resin or the like, and as shown in FIG. 2, totally two pieces thereof are arranged one by one on both side portions in a longitudinal direction of the base board 11 in this embodiment.

As shown in FIG. 3, on tip end portions of the first guide projections 15, head portions 15*b* larger in size of diameter than neck portions 15*a* are formed, and tip end surfaces of the head portions 15*b* are formed into spherical surfaces, each of which has a mushroom cap shape. That is to say, in each of the first guide projections 15, the diameter of the head portion (tip end portion) 15*b* is smaller as the head portion 15*b* is being spaced apart from the base board 11 of the male-side connector 10. The first guide projections 15 as described above are formed as so-called mushroom bumps.

Moreover, while the first guide projections 15 are provided on the male-side connector 10, hole portions 25 through which the first guide projections 15 are to be inserted are formed on the back surface 21*b* of the female-side connector 20, which is the other of the opposite surfaces. The hole portions 25 are provided so as to individually correspond to projected positions of the first guide projections 15, and as shown in FIG. 2, totally two pieces thereof are provided one by one on both side portions in a longitudinal direction of the base board 21.

As shown in FIG. 1, each of the hole portions 25 is formed of: a substantially cross-like slit 25*a* formed on the back surface 21*b* of the base board 21; and an insertion hole 25*c*, which is provided so as to communicate with the slit 25*a* concerned, and is larger in diameter than the first guide projection 15. That is to say, the hole portion 25 is formed with a size capable of allowing a slight operation of the first guide projection 15. In this embodiment, in a similar way to the above-mentioned cross-like slits 23 as the female-type terminal portions, two insertion holes 25*c* are formed in the board body 28 so as to penetrate the same, and on the insulating film 29 and annular pad portions 26, the substantially cross-like slits 25*a* are provided so as to communicate with the insertion holes 25*c*, whereby the hole portions 25 are formed.

Moreover, in this embodiment, in each of the substantially cross-like slits 25*a* of the hole portions 25, an annular opening portion 25*b* is provided, which is formed by cutting away a portion concentrically extended from a center of the slit 25*a* concerned. At this time, the annular opening portion 25*b* is formed so that a hole width thereof can be smaller than a diameter width of the head portion 15*b* of each of the first guide projections 15.

Figure 5:
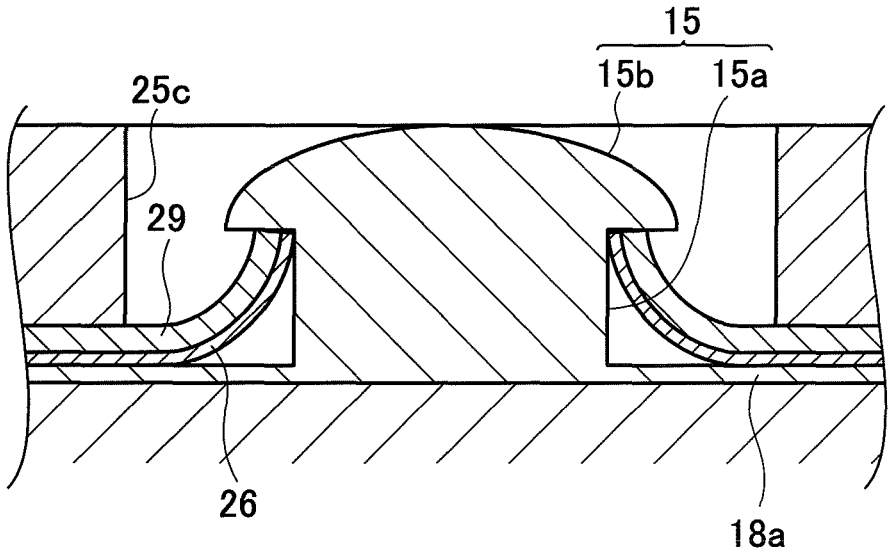
FIG. 5 is a cross-sectional view showing an insertion status of a first guide projection shown in FIG. 4.

In such a way, as shown in FIG. 5, each of the first guide projections 15 is prevented from falling off. Moreover, even if the first guide projection 15 is inserted into the slit 25*a* while being shifted from the center of the slit 25*a* concerned, the neck portion 15*a* can be guided to the center of the slit 25*a* by elastic force of a peripheral edge portion of the slit 25*a*, and relative position accuracy between the first guide projection 15 and the slit 25*a* can be enhanced.

As described above, in the connector assembly 1 of this embodiment, the first guide projections 15 are inserted into the hole portions 25, whereby rough alignment between the columnar bumps 13 as the male-type terminal portions and the cross-like slits 23 as the female-type terminal portions is first performed.

Then, as shown in FIG. 2, on the front surface 11*a* of the base board 11 of the male-side connector 10, which is one of the opposite surfaces of the male-side connector 10 and the female-side connector 20, second guide projections 17 lower in projection height than the first guide projections 15 are provided. In this embodiment, for the second guide projections 17, the same ones as the columnar bumps 13 which are the male-type terminal portions are used, and a pair of columnar bumps arranged diagonally on both side portions in the longitudinal direction of the base board 11 are used as the second guide projections 17.

Meanwhile, on the back surface 21*b* of the base board 21 of the female-type connector 20, which is the other of the opposite surfaces, engagement holes 27 into which the second guide projections 17 are to be engaged are formed. The engagement holes 27 are provided so as to individually correspond to projected positions of the second guide projections 17, and as shown in FIG. 2, are arranged diagonally on both side end portions in the longitudinal direction of the base board 21.

Figure 6:
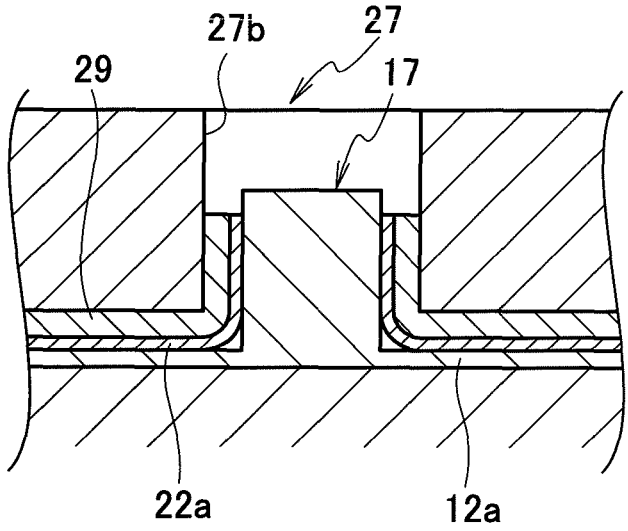
FIG. 6 is a cross-sectional view showing an insertion status of a second guide projection shown in FIG. 4.

As shown in FIG. 1, in a similar way to the cross-like slits 23 as the female-type terminal portions, the engagement holes 27 include cross-like slits 27*a*; however, a size of the insertion holes 27*b* which communicate with the slits 27*a* is different from the size of the through holes 24. That is to say, as shown in FIG. 6, in a state where each of the second guide projections 17 is inserted into the insertion hole 27, the insertion hole 27 concerned is formed with a hole width including thicknesses of the insulating film 29 and the cross-like pad portions 22*a*, in which a clearance with the second guide projection 17 becomes substantially zero. In other words, the engagement hole 27 is formed with a size that enables the second guide projection 17 to be fit thereinto.

Hence, the connector assembly 1, in which the columnar bumps 13 and the cross-like slits 23 are roughly aligned with each other by the first guide projections 15, can accurately position the columnar bumps 13 and the cross-like slits 23 to each other in such a manner that the second guide projections 17 are subsequently inserted into the engagement holes 27.

As described above, in the connector assembly 1 of this embodiment, a two-stage positioning structure is adopted, in which the projection height is different between the first guide projections 15 and the second guide projections 17, which are projected on the surface 11*a* of the male-side connector 10.

In the connector assembly 1 having such a configuration, the front surface 11*a* of the male-side connector 10 and the back surface 21*b* of the female-side connector 20 are opposed to each other while locating the first guide projections 15 in the hole portions 25. The female-side connectors 20 are thrust against the male-side connector 10 side in this state, whereby the first guide projections 15 are inserted into the hole portions 25, and subsequently, the second guide projections 17 are inserted into the engagement holes 27. At this time, the rough alignment is performed by the first guide projections 15. Even if the first guide projections 15 are inserted into the slits 25*a* while being shifted from the centers of the slits 25*a* concerned, the neck portions 15*a* of the first guide projections 15 are guided to the centers of the slits 25*a* by the elastic force of the peripheral edge portions of the slits 25*a*. In such a way, the second guide projections 17 guided to the accurate positions can be inserted into the engagement holes 27. As described above, in accordance with the connector assembly 1 of this embodiment, assembly workability for the male-side connector 10 and the female-side connector 20 can be enhanced to a large extent.

Figure 7:
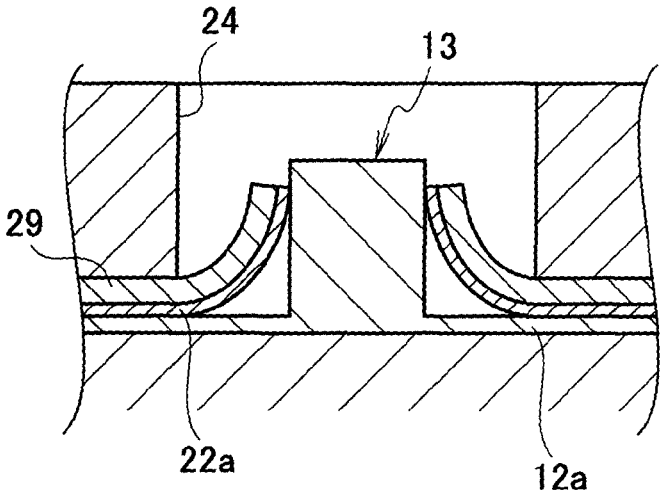
FIG. 7 is a cross-sectional view showing an insertion status of a male-type terminal portion shown in FIG. 4.

Then, the male-side connector 10 and the female-side connector 20 are united with each other (the second guide projections 17 and the engagement holes 27 are fitted to each other), whereby, as shown in FIG. 7, each of the columnar bumps 13 and each of the cross-like slits 23 are fitted to (brought into contact with) each other, electricity is allowed to conduct therebetween, and the male-side connector 10 and the female-side connector 10 are electrically connected to each other.

Note that, as shown in FIG. 4, in the state where the male-side connector 10 and the female-side connector 20 are united with each other, the first guide projections 15, the second guide projections 17 and the columnar bumps 13 do not project from the base board 21, but stay in the insertion holes 25*c*, the insertion holes 27*b* and the insertion holes 24, respectively. Moreover, as shown in FIG. 2, the first guide projections 15 of this embodiment are projected from annular pad portions 18*a* of conductor circuits 18 connected to the respective corner portions of the base board 11.

With the above-described configuration, in the connector assembly 1 of this embodiment, the first guide projections 15 provided on the front surface 11*a* of the male-side connector 10, which is one of the opposite surfaces, are inserted into the hole portions 25 provided on the back surface 21*b* of the female-side connector 20, which is the other of the opposite surfaces. In such a way, the rough alignment between the columnar bumps 13 as the male-type terminal portions and the cross-like slits 23 as the female-type terminal portions can be performed. Hence, while the columnar bumps 13 and the cross-like slits 23 are being enabled to be positioned to each other, the assembly workability for the male-side connector 10 and the female-side connector 20 can be enhanced in comparison with the conventional configuration in which the guide projections and the hole portions are fitted to each other from the beginning.

Moreover, in this embodiment, each of the hole portions 25 includes the substantially cross-like slit 25*a* formed on the back surface 21*b* of the female-side connector 20; and the insertion hole 25*c*, which is provided so as to communicate with the slit 25*a*, and is larger in diameter than the first guide projection 15. Therefore, at the time of inserting the first guide projections 15 into the hole portions 25, the substantially cross-like slits 25*a* serve as marks, and it can be made easy to insert the first guide projections 15 into the centers of the slits 25*a* (hole portions 25). Moreover, the configuration of the hole portions 25, which are formed with the size capable of allowing the slight operations of the first guide projections 15, and position the columnar bumps 13 and the cross-like slits 23 to each other, can be obtained relatively easily.

Furthermore, in this embodiment, the annular opening portions 25*b* are provided in the centers of the substantially cross-like slits 25*a*. Therefore, even if the first guide projections 15 are inserted into the slits 25*a* while being shifted from the centers of the slits 25*a* concerned, the guide projections 15 can be guided to the centers of the slits 25*a* (hole portions 25) by the elastic force of the peripheral edge portions of the slits 25*a*. In such a way, the relative position accuracy between the first guide projections 15 and the hole portions 25, and eventually, relative position accuracy between the male-side connector 10 and the female-side connector 20 can be enhanced.

Moreover, the first guide projections 15 of this embodiment are formed such that the diameter of the head portions (tip end portions) 15*b* thereof are made smaller as a distance of the head portions 15*b* from the base board 11 (base board on the side where the first guide projections 15 are provided increases) of the male-side connector 10. As described above, in this embodiment, the head portions (tip end portions) 15*b* are formed into such a shape tapered in diameter, and accordingly, at the time of inserting the first guide projections 15 into the hole portions 25, the tip end surfaces of the head portions 15*b* serve as guides, and the first guide projections 15 can be smoothly inserted thereinto.

Still further, the first guide projections 15 of this embodiment are formed into the mushroom shape. Therefore, it becomes possible to engage the inserted mushroom-like head portions 15*b* with the peripheral edge portions of the slits 25*a*, whereby the first guide projections 15 are prevented from falling off, thus making it possible to prevent the male-side connector 10 and the female-side connector 20, which are united with each other, from being separated from each other.

Moreover, in this embodiment, on the front surface 11*a* of the male-side connector 10, which is one of the opposite surfaces, there are provided the second guide projections 17 lower in projection height than the first guide projections 15. and on the back surface 21*b* of the female-side connector 20, which is the other of the opposite surfaces, there are provided the engagement holes 27, which have the size that enables the second guide projections 17 to be fit thereinto, wherein the columnar bumps 13 and the cross-like slits 23 are positioned with each other by insertion of the second guide projections 17 through the engagement holes 27. Hence, the connector assembly 1, in which the rough alignment between the columnar bumps 13 and the cross-like slits 23 is performed by the first guide projections 15, can accurately position the columnar bumps 13 and the cross-like slits 23 to each other in such a manner that the second guide projections 17 are subsequently inserted into the engagement holes 27.

In particular, in this embodiment, even if the first guide projections 15 are inserted into the slits 25*a* while being shifted from the centers of the slits 25*a* concerned, the neck portions 15*a* of the first guide projections 15 are guided to the centers of the slits 25*a* by the elastic force of the peripheral edge portions of the slits 25*a*, whereby the second guide projections 17 can be inserted (fitted) into the engagement holes 27. Therefore, the assembly workability for the male-side connector 10 and the female-side connector 20 can be enhanced to a large extent.

Then, in this embodiment, by using the male-side connector 10 for use in the connector assembly 1 as described above, such a male-side connector 10 capable of enhancing the assembly workability for the connector assembly 1 can be obtained.

Next, a description is made of a modification example of the hole portions, into which the first guide projections are inserted, with reference to FIG. 8 to FIG. 11.

Figure 8:
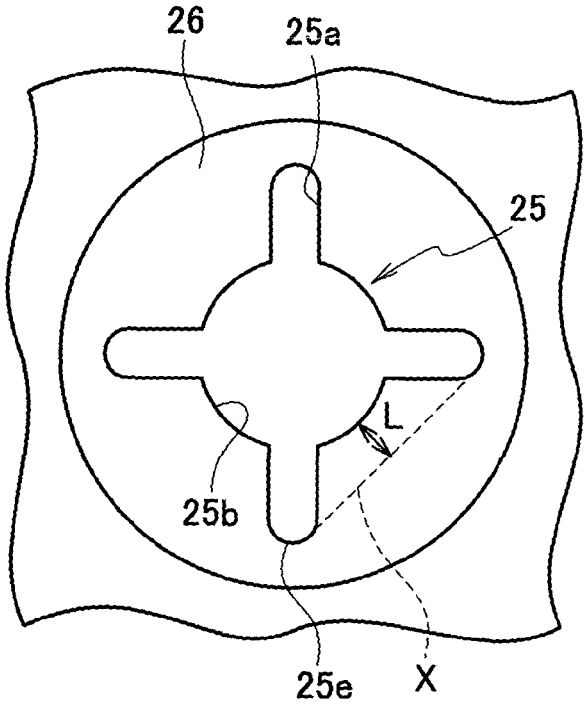
FIG. 8 is an enlarged view of a hole portion shown in FIG. 1.

FIG. 8 is a view showing each of the holes portions for use in the female-type connector according to the one embodiment described above.

As mentioned above, the hole portion 25 is formed of: the substantially cross-like slit 25*a* formed on the back surface 21*b* of the base board 21; and the insertion hole 25*c* (refer to FIG. 2) provided so as to communicate with the slit 25*a*. The annular opening portion 25*b* is provided in the center of the slit 25*a*.

In this case, if a length (spring length) L between a fulcrum X of a spring and the annular opening portion 25*b* is short, the spring connecting tip ends 25*e* of adjacent thin lines of the slit 25*a* to each other, then there is an apprehension that the peripheral edge portion of the slit 25*a*, which includes the fulcrum X, may be broken.

Figure 9:
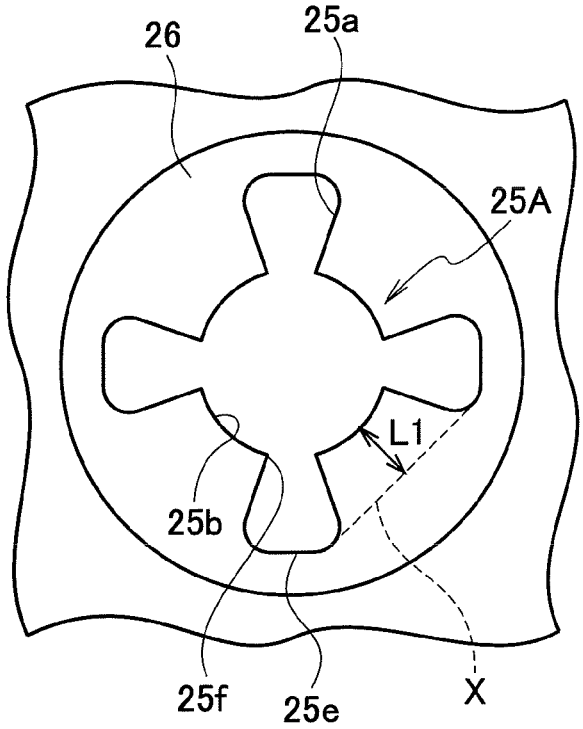
FIG. 9 is a view showing a first modification example of the hole portion shown in FIG. 8.
Figure 10:
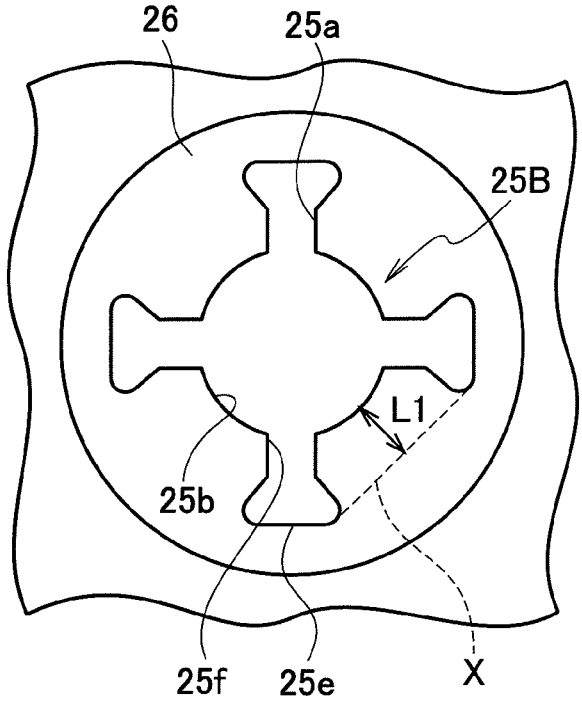
FIG. 10 is a view showing a second modification example of the hole portion shown in FIG. 8.
Figure 11:
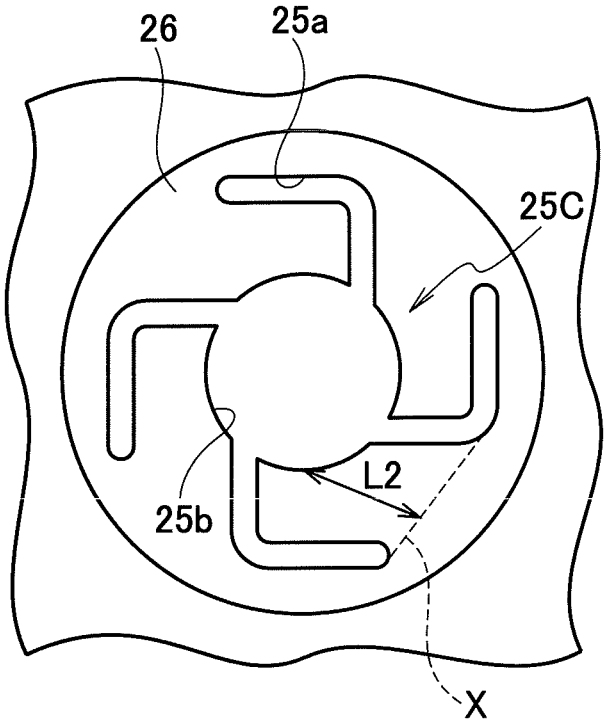
FIG. 11 is a view showing a third modification example of the hole portion shown in FIG. 8.

In this connection, like hole portions 25A to 25C of first to third modification examples shown in FIG. 9 to FIG. 11, the fulcrum X of the spring is located away from the annular opening portion 25*b*, whereby the breakage of the peripheral edge portion of the slit 25*a* can be suppressed.

That is to say, the hole portions 25A and 25B of the first and second modification examples shown in FIG. 9 and FIG. 10 are those in which the tip ends 25*e* side of the slit 25*a* is expanded in comparison with base ends 25*f* side thereof, and the hole portion 25C of the third modification example shown in FIG. 11 is one in which each thin line of the slit 25*a* is bent into a substantial L-shape, whereby the fulcrum X is located away from the annular opening portion 25*b*.

As described above, in accordance with the hole portions 25A to 25C according to the first to third modification examples, spring lengths L1 and L2 can be ensured to be long with respect to the hole portion 25 of the female-side connector 20, which is in accordance with the one embodiment described above. Therefore, even if the first guide projections 15 are repeatedly detached, the peripheral edge portion of the slit 25*a* can be suppressed from being broken.

The description has been made above of the preferred embodiments of the present invention; however, the present invention is not limited to the above-described embodiments, and is modifiable in various ways.

Figure 12:
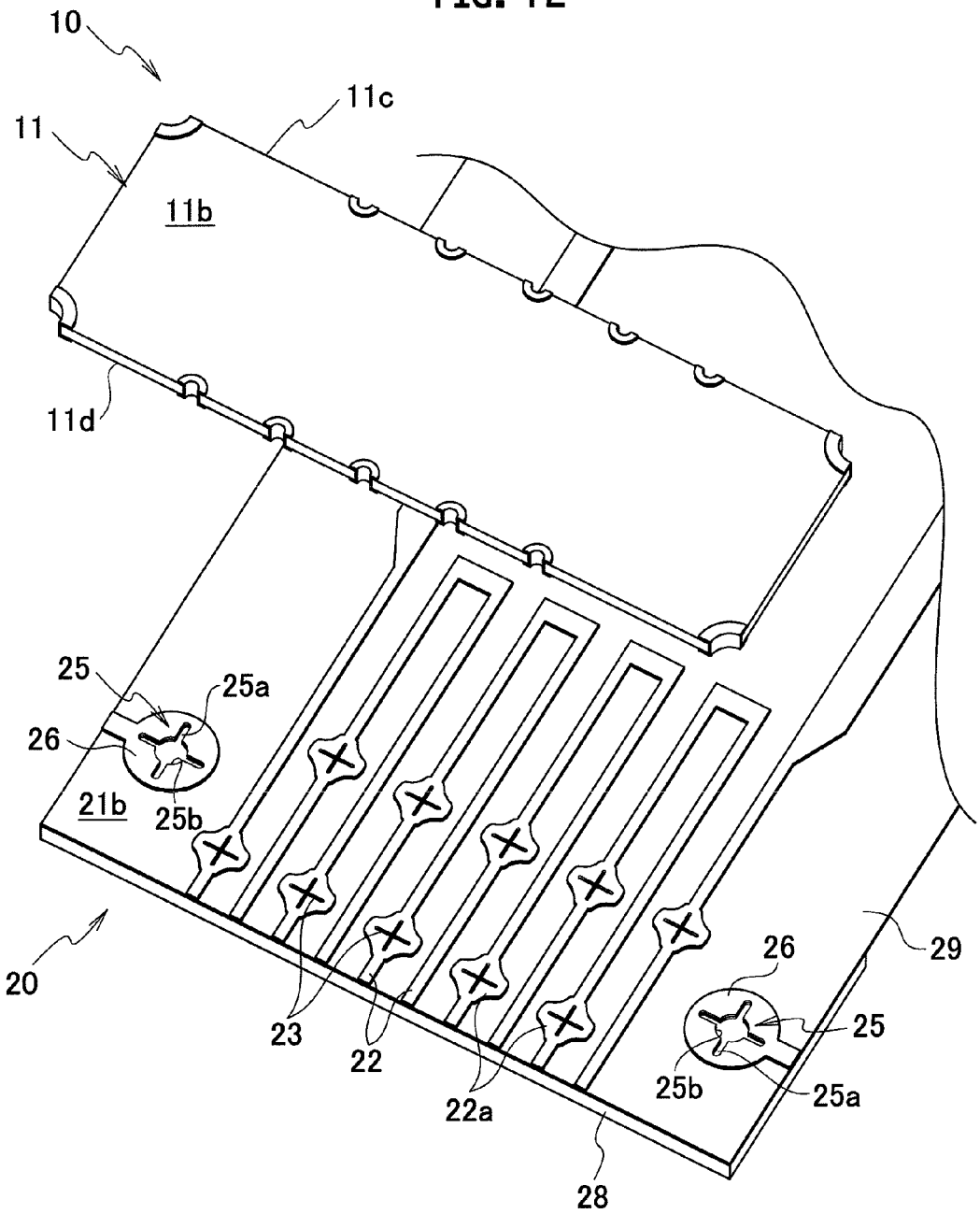
FIG. 12 is a perspective view showing a modification example of the connector assembly shown in FIG. 1, showing a back surface of a male-side connector and a front surface of a female-side connector.
Figure 13:
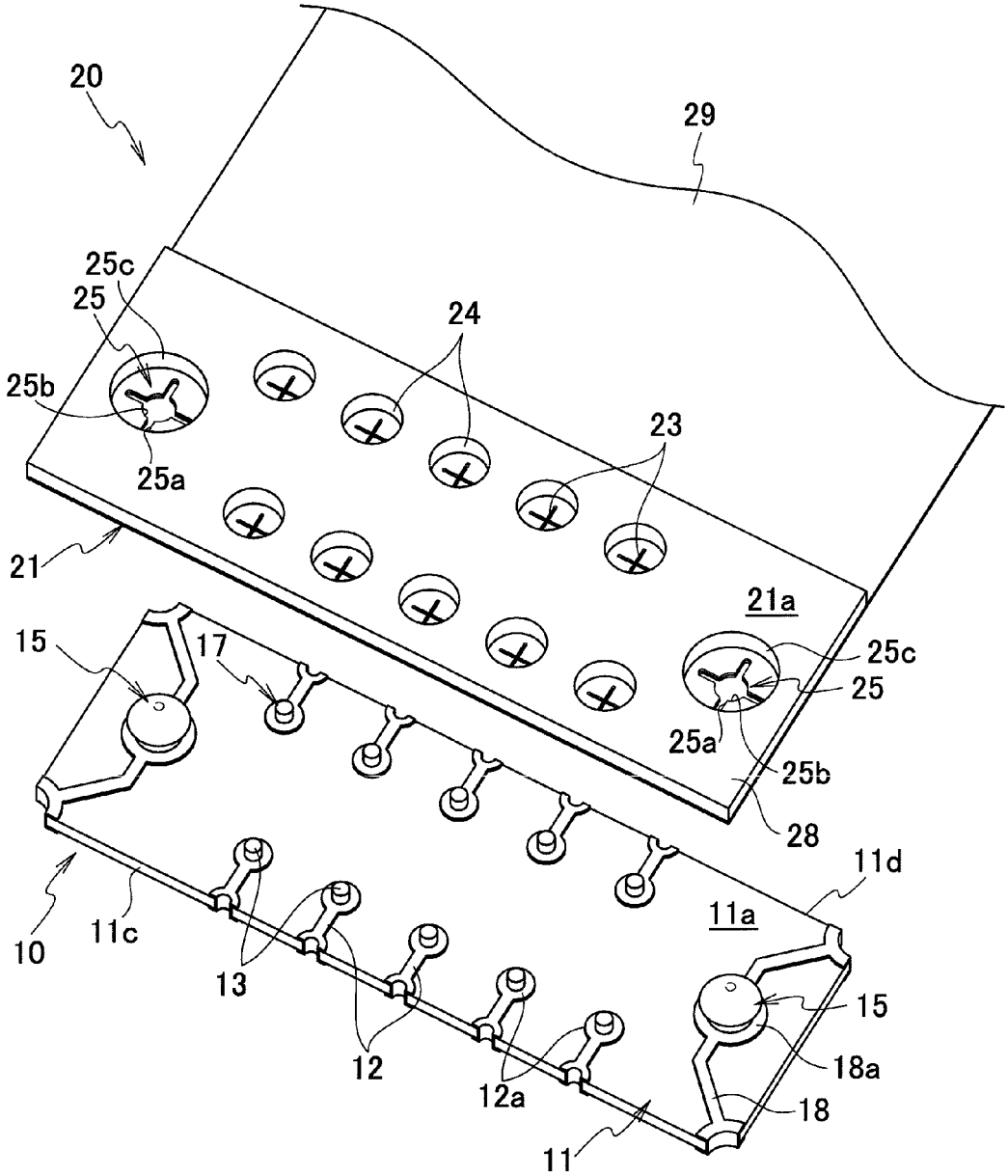
FIG. 13 is a view showing a front surface of the male-type connector shown in FIG. 12 and a back surface of the female-type connector shown in FIG. 12.

For example, as in a modification example shown in FIG. 12 and FIG. 13, as the female-side connector 20 of the connector assembly 1 to be used as an internal component of a cellular phone, one may be used, in which a flexible insulating film 20 and flexible conductor circuits 22 are formed so as to be extended in the width direction of the connector assembly 1.

Moreover, the female-type terminal portions and the male-type terminal portions are not limited to the cross-like slits 23 and the columnar bumps 13, and just need to be those having a terminal portion structure in which both of them allow the electricity to conduct therebetween by being fitted to each other.

Moreover, in the above-described embodiments, the first guide portions 15 are provided on the male-side connector 10, and the hole portions 25 are provided on the female-side connector 20; however, the first guide projections 15 may be provided on the female-side connector 20, and the hole portions 25 may be provided on the male-side connector 10.

Furthermore, in a similar way, the second guide projections 17 may be provided on the female-side connector 20, and the engagement holes 27 may be provided on the male-side connector 10.

What is claimed is:

1. A connector assembly, comprising:

a male-side connector having a male-type terminal portion;

a female-side connector having a female-type terminal portion, the male-side connector and the female-side connector being united with each other while the male-type terminal portion and the female-type terminal portion are brought into contact with each other;

a first guide projection provided on one of opposite surfaces of the male-side connector and the female-side connector that face with each other, the first guide projection having a projection height that is higher than that of the male-type terminal portion; and a hole portion formed at the other of the opposite surfaces, the hole portion having a size allowing slight movement of the first guide projection, wherein the male-type terminal portion and the female-type terminal portion are positioned with each other by the first guide projection being inserted through the hole portion.

2. The connector assembly according to claim 1, wherein the hole portion includes a substantially cross-like slit formed on the other of the opposite surfaces; and an insertion hole provided to communicate with the slit, the insertion hole being larger in diameter than the first guide projection.

3. The connector assembly according to claim 1, wherein the first guide projection is formed such that a diameter of a tip end portion thereof is made smaller as a distance of the head portion from a base board on a side where the first guide projection is provided increases.

4. The connector assembly according to claim 1, wherein the first guide projection is formed into a mushroom shape.

5. The connector assembly according to claim 1, further comprising:

a second guide projection provided on the one of the opposite surfaces of the male-side connector and the female-side connector, the second guide projection being lower in projection height than the first guide projection; and an engagement hole provided at the other of the opposite surfaces, the engagement hole having a size that enables the second guide projection to be fit thereinto, wherein the male-type terminal portion and the female-type terminal portion are positioned with each other by insertion of the second guide projection through the engagement hole.

6. A male-side connector, wherein the male-side connector is used for the connector assembly according to claim 1.

* * * * *